US008505498B2

(12) United States Patent
Acker

(10) Patent No.: US 8,505,498 B2
(45) Date of Patent: Aug. 13, 2013

(54) COMMERCIAL HOT WATER CONTROL SYSTEM

(75) Inventor: Larry K. Acker, Costa Mesa, CA (US)

(73) Assignee: Advanced Conservation Technology Distribution, Inc., Costa Mesa, CA (US)

( * ) Notice: Subject to any disclaimer, the term of this patent is extended or adjusted under 35 U.S.C. 154(b) by 908 days.

(21) Appl. No.: 12/641,236

(22) Filed: Dec. 17, 2009

(65) Prior Publication Data

US 2011/0146593 A1 Jun. 23, 2011

(51) Int. Cl.
*F24D 3/08* (2006.01)

(52) U.S. Cl.
USPC ..... 122/20 R; 137/337; 237/8 A; 237/19

(58) Field of Classification Search
USPC ..... 122/20 R; 237/2 R, 8 A, 8 B, 2 A, 237/19; 137/337, 571
See application file for complete search history.

(56) References Cited

U.S. PATENT DOCUMENTS

| | | | | | |
|---|---|---|---|---|---|
| 3,776,261 | A | * | 12/1973 | Houghton | 137/337 |
| 4,142,515 | A | * | 3/1979 | Skaats | 122/13.3 |
| 4,321,943 | A | | 3/1982 | Haws | |
| 4,371,779 | A | | 2/1983 | Maynard et al. | |
| 4,446,912 | A | | 5/1984 | Rickman, Jr. | |
| 4,508,261 | A | | 4/1985 | Blank | |
| 4,620,667 | A | | 11/1986 | Vandermeyden et al. | |
| 4,832,259 | A | | 5/1989 | Vandermeyden | |
| 4,930,551 | A | | 6/1990 | Haws | |
| 5,042,524 | A | * | 8/1991 | Lund | 137/337 |
| 5,056,712 | A | * | 10/1991 | Enck | 236/20 R |
| 5,128,517 | A | * | 7/1992 | Bailey et al. | 219/506 |
| 5,277,219 | A | | 1/1994 | Lund | |
| 5,626,287 | A | * | 5/1997 | Krause et al. | 236/20 R |
| 5,829,475 | A | | 11/1998 | Acker | |
| 6,293,471 | B1 | | 9/2001 | Stettin et al. | |
| 6,355,913 | B1 | | 3/2002 | Authier et al. | |
| 6,962,162 | B2 | | 11/2005 | Acker | |
| 7,065,431 | B2 | | 6/2006 | Patterson et al. | |
| 7,726,263 | B2 | * | 6/2010 | Ben-Ishai | 122/20 R |
| 7,883,024 | B2 | * | 2/2011 | Nakayama et al. | 237/28 |
| 8,172,157 | B2 | * | 5/2012 | Nakagawa et al. | 237/12.1 |
| 8,191,513 | B2 | * | 6/2012 | Krause et al. | 122/415 |
| 2006/0230772 | A1 | | 10/2006 | Wacknov et al. | |
| 2008/0115839 | A1 | | 5/2008 | Acker | |
| 2008/0223451 | A1 | | 9/2008 | Acker | |

* cited by examiner

*Primary Examiner* — Gregory A Wilson
(74) *Attorney, Agent, or Firm* — Carlos A. Fisher

(57) ABSTRACT

A commercial hot water system includes a boiler, a storage tank, and a hot water delivery line connected between the storage tank and at least one plumbing fixture along with a cold water delivery line connection between said plumbing fixture, a cold water source and said boiler. A pump, interconnected between the hot and cold water delivery lines, enables circulation of water to the fixtures. A timer and controller provides for turning on the pump and a temperature sensor, connected to the controller, is effective in stopping the pump to prevent heated water from being circulated through the cold water line.

4 Claims, 1 Drawing Sheet

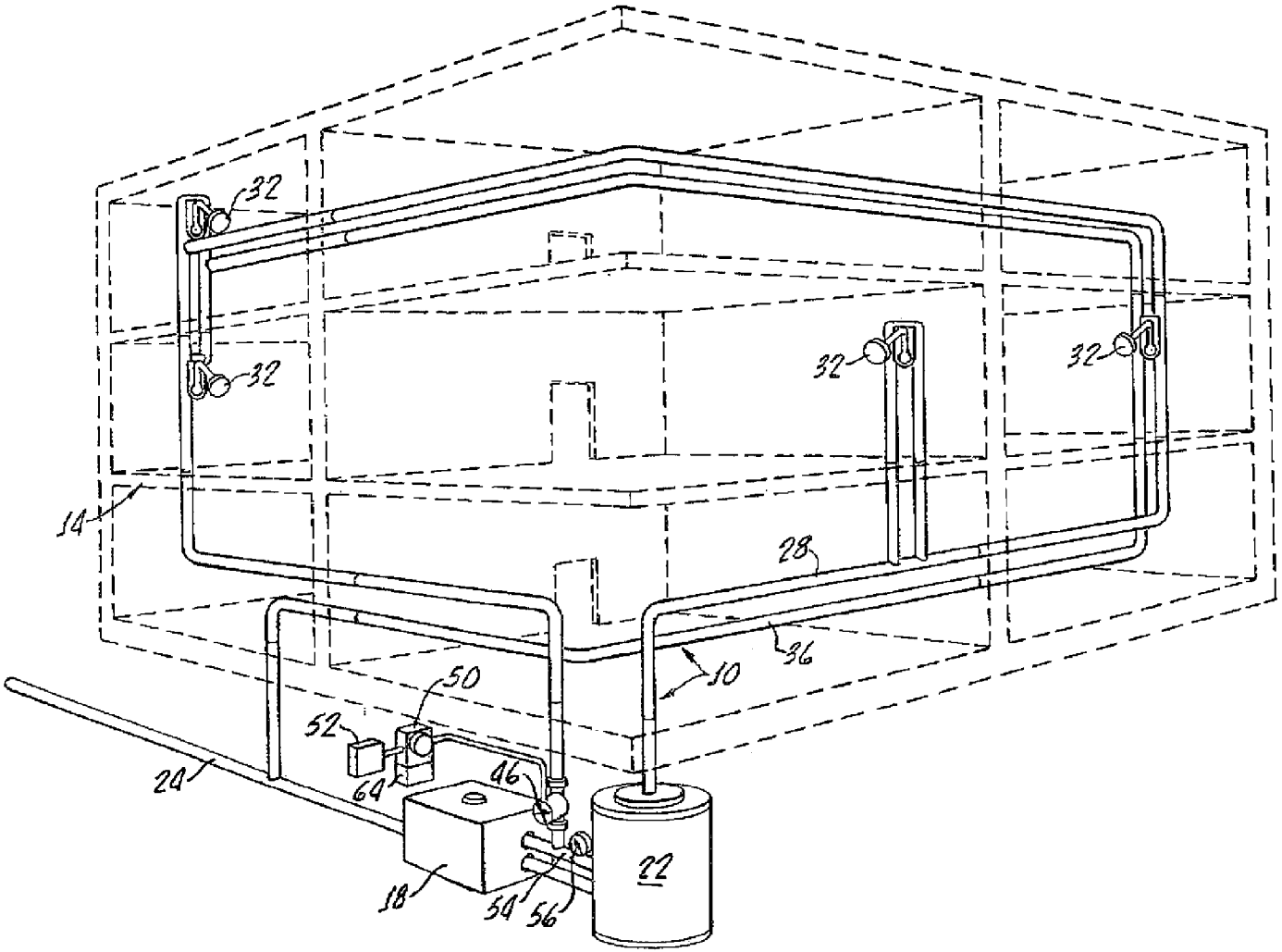
32
32
32
32
28
26
10
22
56
54
46
50
64
52
18
24
14

COMMERCIAL HOT WATER CONTROL SYSTEM

The present invention is generally directed to plumbing systems and more particularly directed to commercial plumbing systems with energy saving recirculation of water.

In large buildings, such as, for example, apartment buildings, hotels, motels, and other commercial buildings, the boiler, or hot water supply, is disposed remotely to the point of use of hot water. Accordingly, if the water in the piping system has cooled, a user may have to run the water for an extended period of time in order to get hot water to a fixture.

In this case, water is wasted because the cold hot water in the pipes is typically discharged into a drain during a period of time waiting for the arrival of hot water. Energy is also wasted because the discharged water was heated previously by the boiler.

This problem of both water waste and inconvenience has been solved by providing hot water recirculation systems which are installed in commercial buildings. Continuous circulation of hot water around the loop is quickly available at various points of use throughout the building. Most often, an electrically driven pump is installed at an end of a return line which draws hot water from the supply side of the boiler and returns it to the cold water inlet of the hot water supply.

This type of system enables quick access to hot water and, in fact, saves water; however, it is wasteful from an energy conservation point of view.

Even when insulated recirculation pipes have a high heat loss. Accordingly, the heat loss from a continuously operating recirculation system can be quite high.

In order to conserve energy, systems may be configured to turn off the recirculation pump at specific times. This is effected through a time clock which operates recirculation pump during the day and turns the pipe off at night.

While this system will reduce the heat loss at night, it has a severe drawback because recirculation is actually needed most during the evening. That is, during the day in an apartment building or hotel/motel, people will often use hot water at a number of fixtures throughout the building. This water draw keeps water in the distribution system thereby providing hot water quickly.

However, at night, very little hot water use occurs. When a person uses hot water at night, without operation of the recirculation pump a long time may be necessary for hot water to arrive at a remote fixture.

Accordingly, the system is desirable which enables the continuous, or sporadic, use of recirculation to maximize efficiency of this system. The present invention solves that problem.

SUMMARY OF THE INVENTION

A hot water delivery system in accordance with the present invention generally includes a boiler having a storage tank interconnected therewith and hot water delivery lines connected between the storage tank and at least one plumbing fixture. A cold water delivery line is provided and connected between the plumbing fixture and a cold water source and the boiler for delivering cold water thereto.

A pump is provided which is interconnected between the boiler and the storage tank, for circulation of the water from the storage tank to the fixture and return to the storage tank. A controller causes the pump to circulate water.

A temperature sensor, connected to the control system, is provided for causing the controller to stop the pump to prevent heated water from being circulated and a timer connected to the controller is provided for causing the controller to turn on the pump. Alternatively, a flow detector may be installed in the hot water delivery line and connected to the controller for automatically causing the controller to turn on the pump.

BRIEF DESCRIPTION OF THE DRAWINGS

The advantages and features of the present invention will appear from the following description when considered in conjunction with the accompanying drawing, in which:

FIG. 1 is a flow diagram of a plumbing system 10 in accordance with the present invention for a commercial establishment, such as an apartment building, generally showing a boiler and conduits, in communication with at least one plumbing fixture, along with a pump, flow switch, controller, and timer.

DETAILED DESCRIPTION OF THE DRAWINGS

Referring to FIG. 1, there is shown a hot water recovery system 10 for a building 14 which generally includes a boiler 18, connected to a storage tank 22, and supplied by a feed line 24. A hot water delivery line 28 connecting the tank 22 with a plurality of plumbing fixtures 32 that are dispersed throughout the building 14. Also provided is a cold water delivery line 36 interconnecting the fixtures 32 with a cold water line 36 which is also interconnected with the boiler 18.

A pump 46 is connected between the boiler 18 and storage tank 22 for circulation of water to and from the fixture 32 in order to provide "instant" hot water at the fixtures and a controller 50 provides for switching electrical current from an outlet 52 to the pump 46 in order to cause the pump 46 to circulate water from the storage tank 22 to the fixture 32.

A temperature sensor, or flow detector, 56 may be disposed in a line 54 interconnecting the pump 46 with the storage tank 22 and causes the controller 50 to stop the pump 46 to prevent heated water from being circulated. The temperature sensor 56 may be a thermistor type of detector strapped to the outside of the line 54.

The temperature sensor 56 is preferably configured for detecting a temperature increase, or gradient, such as one or two degrees and in response thereto, causing the control system 52 stop the pump 46. Thus, no matter what the actual temperature of the water in the line 54 is, an increase of one or two degrees will cause the pump 46 to stop. Preferably, a timer 64 may be incorporated into the controller 50 for causing the controller 50 to turn on the pump 46 at preset times; however, the pump is stopped by the controller 50 through the temperature sensor 56.

Although the timer 64 is shown incorporated into the controller 50 it may be disposed anywhere in the system.

Although there has been hereinabove described a specific commercial hot water system in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A commercial hot water system comprising:

a) a boiler;

b) a hot water storage tank interconnected with said boiler;

c) a hot water delivery line connection between said plumbing fixture, a cold water source and said boiler;

d) a pump connected between said boiler and the storage tank for circulation of water from the storage tank to said fixture and return to said storage tank;

e) a controller for causing said pump to circulate the water back to the hot water source when hot water at a plumbing fixture is turned on; and f) a temperature sensor located on the hot water delivery line upstream from the plumbing fixture, connected to said controller, wherein said temperature sensor is structured to detect a hot water temperature increase of two degrees or more, and to cause the controller to stop the pump if said hot water temperature increase is exceeded in order to prevent heated water from being circulated.

2. The hot water system according to claim 1 further comprising a flow detector, disposed in said hot water delivery line and connected to said controller, for causing the controller to turn on the pump.

3. The hot water system according to claim 1 wherein said temperature sensor is disposed in a water line connecting the hot water delivery line and the pump.

4. The hot water system of claim 1 further comprising a timer, connected to said controller, for causing the controller to turn on the pump at a preset time.

* * * * *